US010431936B2

(12) United States Patent
Horning et al.

(10) Patent No.: US 10,431,936 B2
(45) Date of Patent: Oct. 1, 2019

(54) ELECTRICAL CONNECTOR WITH IMPEDANCE CONTROL MEMBERS AT MATING INTERFACE

(71) Applicant: TE CONNECTIVITY CORPORATION, Berwyn, PA (US)

(72) Inventors: Michael James Horning, Landisville, PA (US); David Allison Trout, Lancaster, PA (US); Justin Dennis Pickel, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/718,183

(22) Filed: Sep. 28, 2017

(65) Prior Publication Data

US 2019/0097356 A1 Mar. 28, 2019

(51) Int. Cl.

| | |
|---|---|
| ***H01R 13/6473*** | (2011.01) |
| ***H01R 13/502*** | (2006.01) |
| *H01R 13/6585* | (2011.01) |
| *H01R 12/58* | (2011.01) |
| *H01R 12/71* | (2011.01) |
| *H01R 12/73* | (2011.01) |
| *H01R 13/6594* | (2011.01) |

(52) U.S. Cl.

CPC ..... *H01R 13/6473* (2013.01); *H01R 13/502* (2013.01); *H01R 12/585* (2013.01); *H01R 12/716* (2013.01); *H01R 12/73* (2013.01); *H01R 13/6585* (2013.01); *H01R 13/6594* (2013.01)

(58) Field of Classification Search

CPC ..... H01R 13/6585; H01R 13/6586; H01R 13/688; H01R 13/6596

USPC ..... 439/95, 108, 607.05, 0.08

See application file for complete search history.

(56) References Cited

U.S. PATENT DOCUMENTS

| | | | | |
|---|---|---|---|---|
| 8,444,434 | B2 | 5/2013 | Davis et al. | |
| 8,662,924 | B2 | 3/2014 | Davis et al. | |
| 8,715,003 | B2 | 5/2014 | Buck et al. | |
| 9,831,608 | B1 * | 11/2017 | Pickel | H01R 13/6471 |
| 9,859,640 | B1 * | 1/2018 | Horning | H01R 13/03 |
| 2013/0280957 | A1 * | 10/2013 | Davis | H01R 13/6477 439/620.21 |
| 2014/0220798 | A1 * | 8/2014 | Putt, Jr. | H01R 13/652 439/95 |
| 2015/0031238 | A1 * | 1/2015 | Davis | H01R 23/688 439/607.05 |
| 2018/0026400 | A1 * | 1/2018 | Morgan | H01R 12/52 439/78 |

* cited by examiner

*Primary Examiner* — Hien D Vu

(57) ABSTRACT

An electrical connector includes a housing, plural signal contacts, and plural impedance control (IC) members. The housing includes a base having a mating face. The base includes an array of openings along the mating face. The signal contacts are arranged in contact pairs, and are held in the openings of the base. The signal contacts include mating segments that extend a height beyond the mating face of the base for electrically connecting to corresponding mating signal contacts of a mating connector. The IC members are on the base and extend a height beyond the mating face of the base that is less than the height of the mating segments of the signal contacts. Each of the IC members is disposed one or more of adjacent to or between the signal contacts of a corresponding contact pair.

12 Claims, 9 Drawing Sheets

ELECTRICAL CONNECTOR WITH IMPEDANCE CONTROL MEMBERS AT MATING INTERFACE

BACKGROUND OF THE INVENTION

The subject matter herein relates generally to impedance control of an electrical connector at a mating interface between the electrical connector and a mating connector.

Some electrical connector systems utilize receptacle and header connectors to interconnect two circuit boards, such as a motherboard and daughter card. When the connectors are mated, the circuit boards may be arranged parallel to one another. Such connector systems can be complex and difficult to manufacture.

The connectors can have ground shields that are designed to shield signal contacts from other signal contacts within the connectors. During a mating operation, the ground shields of the header connector engage the ground shields of the receptacle connector and the signal contacts of the header connector engage the signal contacts of the receptacle connector. The connectors are fully mated relative to one another when mating faces of the respective housings of the two connectors abut against one another at a mating interface, blocking additional movement in a mating direction. The connectors are partially mated to one another when the ground shields and signal contacts of the two connectors are engaged but the mating faces of the housings do not abut against one another. Partial mating of the connectors may occur when, due to various aggregated tolerances in the electrical system or device, the two circuit boards are farther apart from each other than the combined length of the two connectors in a fully mated state of the connectors. For example, the two circuit boards may be fixed in place on different mounts of a chassis, and the distance between the two circuit boards may not be precisely controlled due to aggregated tolerances between various components in the system.

Although partial mating of the connectors provides an electrically conductive path that enables signal transmission between the circuit boards, the signal quality and/or signal strength may be degraded when the connectors are partially mated relative to the signal quality and/or strength when the two connectors are fully mated. For example, when the connectors are partially mated, an air gap is present along the mating interface between the mating faces of the respective housings of the connectors. Some air gaps may be present even when the connectors are fully mated, but in general the amount and/or size of the air gaps at the mating interface are greater when the connectors are partially mated rather than fully mated. The air gaps cause an electrical discontinuity. For example, the electrical discontinuity may represent an impedance spike that causes some of the electrical energy along the signal path to reflect back to the source instead of being transmitted across the connectors. The detrimental effect of the electrical discontinuity may be exacerbated at higher signal transmission speeds, such as speeds over 10 Gb/s.

A need remains for a high speed electrical connector system with improved electrical performance (e.g., electrical signal transmission) by controlling the impedance at the mating interface.

BRIEF DESCRIPTION OF THE INVENTION

In one or more embodiments, an electrical connector is provided that includes a housing, plural signal contacts, and plural impedance control (IC) members. The housing includes a base having a mating face. The base includes an array of openings along the mating face. The signal contacts are arranged in contact pairs, and are held in the openings of the base. The signal contacts include mating segments that extend a height beyond the mating face of the base for electrically connecting to corresponding mating signal contacts of a mating connector. The IC members are on the base and extend a height beyond the mating face of the base that is less than the height of the mating segments of the signal contacts. Each of the IC members is disposed one or more of adjacent to or between the signal contacts of a corresponding contact pair.

In one or more embodiments, an electrical connector is provided that includes a housing and plural signal contacts. The housing includes a base having a mating face. The base includes divider walls and septums that define an array of signal apertures. The signal apertures extend through the base from the mating face. The signal apertures are arranged in pairs. Each septum extends between and separates the two signal apertures in a corresponding one of the pairs. The signal contacts are held in the signal apertures of the base. The signal contacts include mating segments that extend beyond the mating face of the base for electrically connecting to corresponding mating signal contacts of a mating connector. The signal contacts that are held in a common pair of the signal apertures represent a contact pair. The septums of the base include inter-contact protrusions. The inter-contact protrusions extend a height beyond the mating face of the base between the signal contacts of each contact pair.

In one or more embodiments, a connector system is provided that includes a header connector and a receptacle connector. The header connector includes a header housing having a mating face. The header housing holds plural header signal contacts. The header signal contacts have mating segments that extend beyond the mating face. The header signal contacts are arranged in contact pairs within the header housing. The header housing includes impedance control (IC) members that project beyond the mating face. The IC members include inter-contact protrusions that are located between the mating segments of the header signal contacts in each contact pair. The receptacle connector includes a receptacle housing having a mating face. The mating face of the receptacle housing is configured to abut the mating face of the header housing at a mating interface when the receptacle connector is fully mated to the header connector. The receptacle housing defines guide tunnels along the mating face. Each guide tunnel is fluidly connected to a corresponding pair of signal openings that extend through the receptacle housing such that the guide tunnel provides a lead-in space to the pair of signal openings. The signal openings are configured to receive the mating segments of the header signal contacts therein through the guide tunnels to electrically connect to receptacle signal contacts held in the signal openings. The IC members of the header housing are configured to extend across the mating interface when the header connector is fully mated to the receptacle connector such that the inter-contact protrusions are received into the guide tunnels of the receptacle housing.

DETAILED DESCRIPTION OF THE INVENTION

Figure 1:
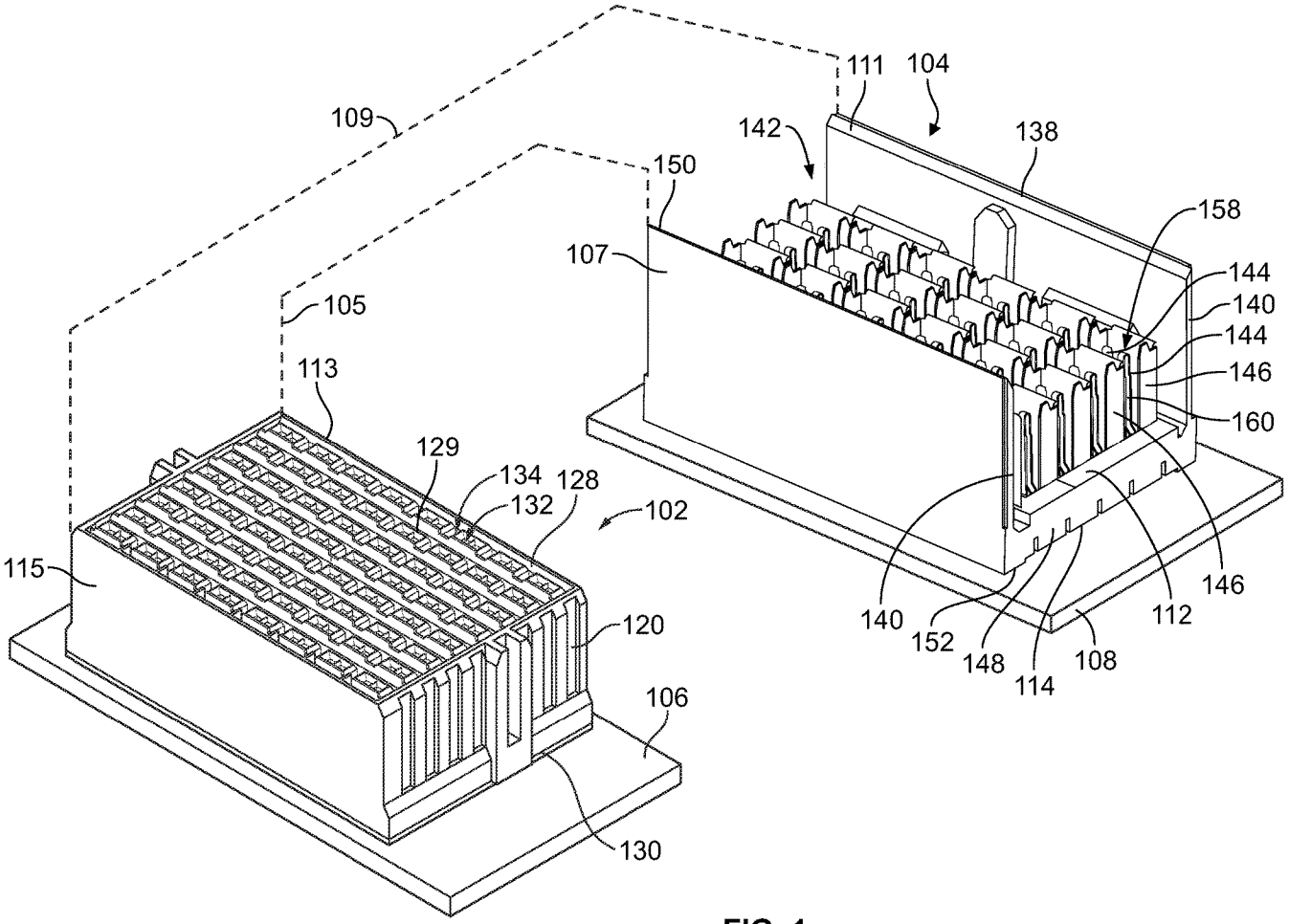
FIG. 1 is a perspective view of a connector system including a receptacle connector and a header connector according to an embodiment.

FIG. 1 is a perspective view of a connector system 100 including a receptacle connector 102 and a header connector 104 according to an embodiment. The receptacle and header connectors 102, 104 are configured to be directly mated to each other to provide an electrically conductive path across the connectors 102, 104 for signal transmission. In an embodiment, the receptacle connector 102 is mounted to and electrically connected to a first circuit board 106, and the header connector 104 is mounted to and electrically connected to a second circuit board 108. The receptacle and header connectors 102, 104 are utilized to electrically connect the circuit boards 106, 108 to one another at a separable mating interface.

The header connector 104 can be mated to the receptacle connector 102 by rotating the header connector 104 (and the second circuit board 108) approximately 180 degrees such that a mating end 150 of the header connector 104 can engage a mating end 128 of the receptacle connector 102. In FIG. 1, the line 105 shows a mating trajectory of a first elongated side 107 of the header connector 104, and the line 109 shows a mating trajectory of a second elongated side 111 of the header connector 104 that is opposite to the first elongated side 107 as the header connector 104 is moved towards the receptacle connector 102. During the mating process, the first elongated side 107 of the header connector 104 generally aligns with a first elongated side 113 of the receptacle connector 102, and the second elongated side 111 generally aligns with a second elongated side 115 of the receptacle connector 102 that is opposite to the first elongated side 113. As used herein, relative or spatial terms such as "first," "second," "front," "rear," "top," and "bottom," are only used to distinguish the referenced elements and do not necessarily require particular positions or orientations relative to the surrounding environment of the connector system 100.

When the connectors 102, 104 are mated, the connectors 102, 104 are stacked between the two circuit boards 106, 108 in a mezzanine arrangement. The circuit boards 106, 108 may be oriented parallel to one another on opposite sides of the mated connectors 102, 104. The circuit boards 106, 108 may be oriented horizontally, with the connectors 102, 104 extending vertically between the horizontal circuit boards 106, 108. The connectors 102, 104 may be in-line connectors such that the signal contacts thereof extend generally linearly between the circuit boards 106, 108. Other orientations of the circuit boards 106, 108 are possible in alternative embodiments. For example, one or both of the connectors 102, 104 may be a right angle connector instead of an in-line connector. In another embodiment, one or both of the connectors 102, 104 may be cable-mounted to an electrical cable instead of mounted to a circuit board.

Figure 6:
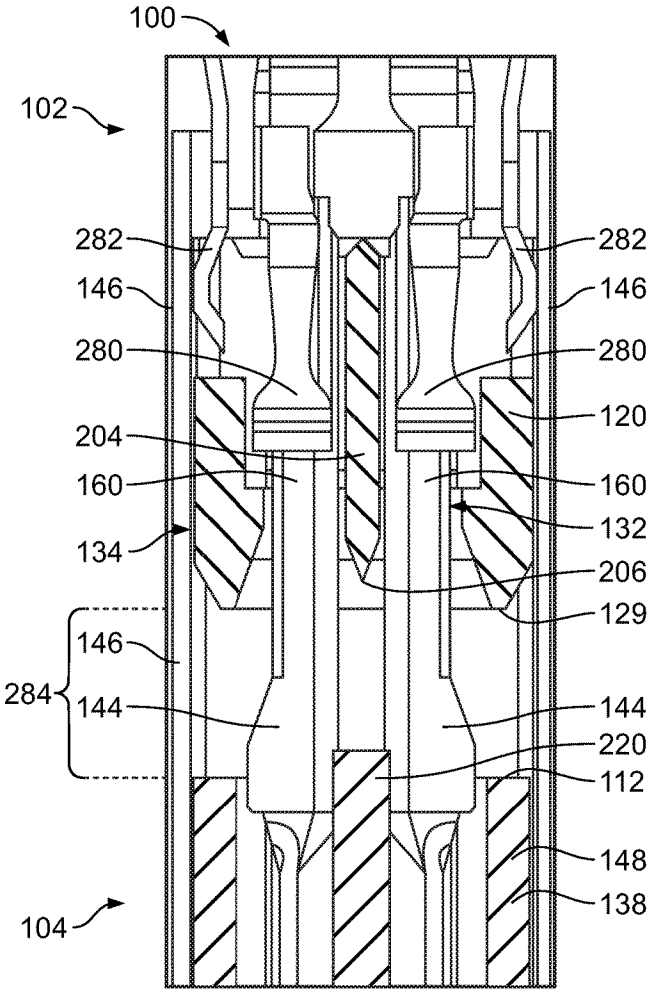
FIG. 6 is a cross-sectional view of portions of the header connector and the receptacle connector of the connector system in a partially mated position.

The receptacle connector 102 includes a receptacle housing 120 that holds a plurality of receptacle signal contacts 280 (shown in FIG. 6). The receptacle signal contacts 280 are electrically shielded by receptacle ground contacts 282 (shown in FIG. 6). The receptacle housing 120 extends between the mating end 128 and a mounting end 130, which is opposite to the mating end 128. The receptacle housing 120 includes a mating face 129 at the mating end 128. The mounting end 130 faces the first circuit board 106. For example, although not shown, the receptacle signal contacts 280 and the receptacle ground contacts 282 may protrude beyond the mounting end 130 of the receptacle housing 120 for electrically terminating (for example, electrically connecting in direct mechanical engagement) to the first circuit board 106. In the illustrated embodiment, the mounting end 130 is oriented substantially parallel to the mating face 129 at the mating end 128.

The receptacle housing 120 defines a plurality of signal openings 132 and a plurality of ground slots 134. The receptacle signal contacts 280 are disposed in the corresponding signal openings 132, and the receptacle ground contacts 282 are disposed in the ground slots 134. The receptacle housing 120 may be manufactured from a dielectric material, such as a plastic material, that provides electrical insulation between the signal contact openings 132 and the ground slots 134.

The header connector 104 includes a header housing 138 extending between the mating end 150 and a mounting end 152 that is opposite to the mating end 150. The mounting end 152 faces the second circuit board 108. The header housing 138 includes a base wall or housing base 148, referred to herein as a base 148. The base 148 has a mating face 112 and a mounting face 114 that is opposite to the mating face 112. The mounting face 114 may define the mounting end 152 of the header housing 138. The header connector 104 includes header signal contacts 144 that are held in the base 148. The header signal contacts 144 have mating segments 160 that extend from the mating face 112 to be received in the corresponding signal openings 132 of the receptacle housing 120 during mating of the connectors 102, 104. In the illustrated embodiment, both the receptacle connector 102 and the header connector 104 are vertical (or linear) connectors such that the mating ends are generally in-line with the respective mounting ends, and the mating faces are generally parallel to the mounting faces. But, in an alternative embodiment, at least one of the receptacle connector 102 or the header connector 104 may have a different orientation, such as a right angle orientation in which the mating and mounting ends are not in-line and the mating and mounting faces are transverse to each other.

The header connector 104 also includes header ground shields 146 that are held in the base 148 and at least partially surround the signal contacts 144. The header ground shields 146 extend from the mating face 112 to be received in the corresponding ground slots 134 of the receptacle housing 120 during mating. Although not shown in FIG. 1, the header signal contacts 144 and the header ground shields 146 have tail segments that protrude from the mounting face 114 of the base 148 to terminate to the second circuit board 108.

In an embodiment, the header housing 138 includes shroud walls 140 that extend from the base 148 to the mating end 150 of the housing 138. The shroud walls 140 and the mating face 112 of the base 148 define a cavity 142 that is open at the mating end 150. For example, the shroud walls 140 define sides of the cavity 142 and the mating face 112 defines a bottom or back end of the cavity 142. During the mating operation, the receptacle connector 102 is received in the cavity 142 through the mating end 150. The receptacle housing 120 may engage the shroud walls 140 to guide the receptacle connector 102 into alignment with the header connector 104. In an alternative embodiment, the header housing 138 may include additional shroud walls that extend between the two illustrated shroud walls 140 to fully-enclose a perimeter of the cavity 142. In another alternative embodiment, the housing 138 does not have any shroud walls 140.

The header signal contacts 144 and ground shields 146 extend beyond the mating face 112 into the cavity 142. The portions of the ground shields 146 within the cavity 142 at least partially surround and electrically shield the mating segments 160 of the signal contacts 144. In the illustrated embodiment, the ground shields 146 each surround a corresponding contact pair 158 of signal contacts 144 on three sides of the contact pair 158. An adjacent ground shield 146 in the same column or row provides shielding for the contact pair 158 along the open, fourth side of the pair 158. In other embodiments, the ground shields 146 may more fully or less fully surround corresponding signal contacts 144. For example, each ground shield 146 may surround a corresponding pair 158 of signal contacts 144 along only two sides thereof.

Figure 2:
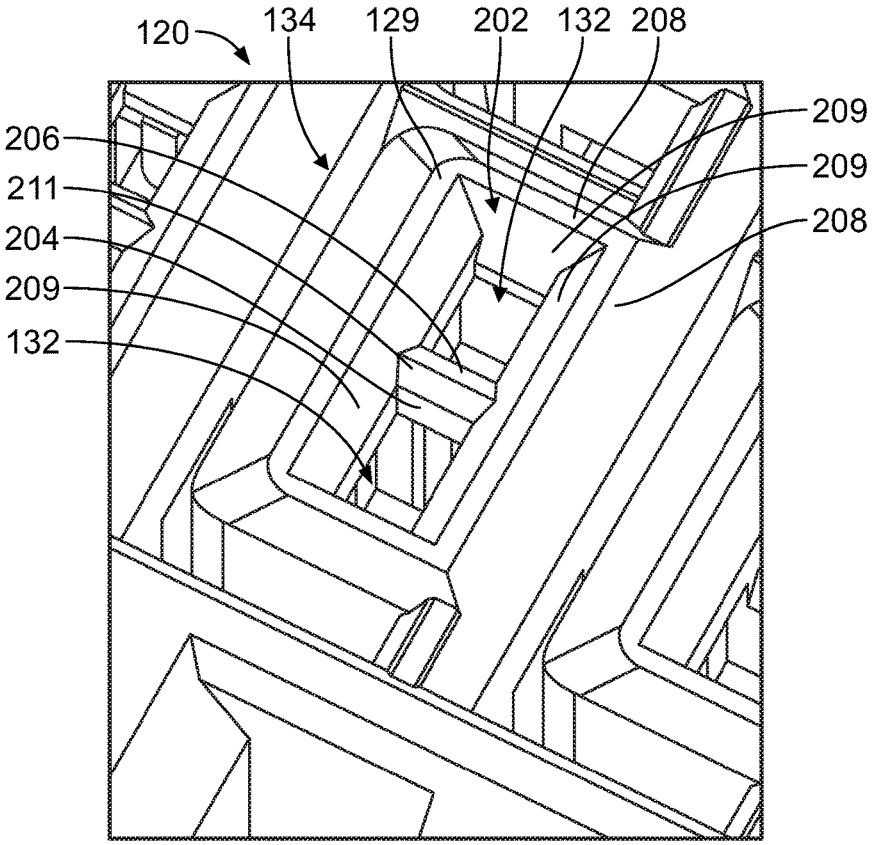
FIG. 2 is a close-up perspective view of a portion of a mating face of a receptacle housing of the receptacle connector according to an embodiment.

FIG. 2 is a close-up perspective view of a portion of the mating face 129 of the receptacle housing 120 according to an embodiment. The receptacle housing defines guide tunnels 202 along the mating face 129. In the illustrated embodiment, each guide tunnel 202 is surrounded on three sides by a corresponding ground slot 134. The guide tunnels 202 are each fluidly connected to a corresponding pair of signal openings 132 of the receptacle housing 120. For example, the guide tunnels 202 extend between the signal openings 132 and the mating face 129.

The guide tunnels 202 are configured to provide lead-in spaces that guide the header signal contacts 144 (shown in FIG. 1) of the header connector 104 (FIG. 1) into the signal openings 132 during mating. For example, each guide tunnel 202 includes four walls 208 that each have a ramped inner surface 209 that slopes inward from the mating face 129 downward (e.g., into the housing 120). Thus, the opening of the guide tunnel 202 at the mating face 129 is has a greater size (e.g., area) than the area of the guide tunnel 202 farther into the receptacle housing 120. If the header signal contacts 144 are slightly misaligned initially, the signal contacts 144 may engage the ramped inner surfaces 209 which guide the signal contacts 144 into the signal openings 132 without stubbing.

The two signal openings 132 in each pair are separated from each other by a rib 204 of the receptacle housing 120. The rib 204 has a mating end 206 that is recessed relative to the mating face 129 of the receptacle housing 120. For example, the guide tunnel 202 defines the space between the mating end 206 of the rib 204 and the mating face 129. In one or more embodiments, the mating end 206 of the rib 204 may be recessed from the mating face 129 by a distance between about 0.3 mm and about 1.8 mm. In some embodiments, the mating end 206 is recessed from the mating face 129 by a distance between about 0.5 mm and about 1.5 mm. In the illustrated embodiment, the rib 204 includes a tapered tip 211 at the mating end 206. A lateral width of the rib 204 decreases along the tapered tip 211 with increasing proximity to the mating end 206, such that the width of the mating end 206 is less than a width of the rib 204 farther into the receptacle housing 120. Optionally, the tapered tip 211 may extend partially into the guide tunnel 202. The tapered tip 211 may be connected between opposing ramped inner surfaces 209 of the guide tunnel 202. The mating end 206 of the rib 204 is recessed from the mating face 129, so the tapered tip 211 does not extend all the way to the mating face 129.

Figure 3:
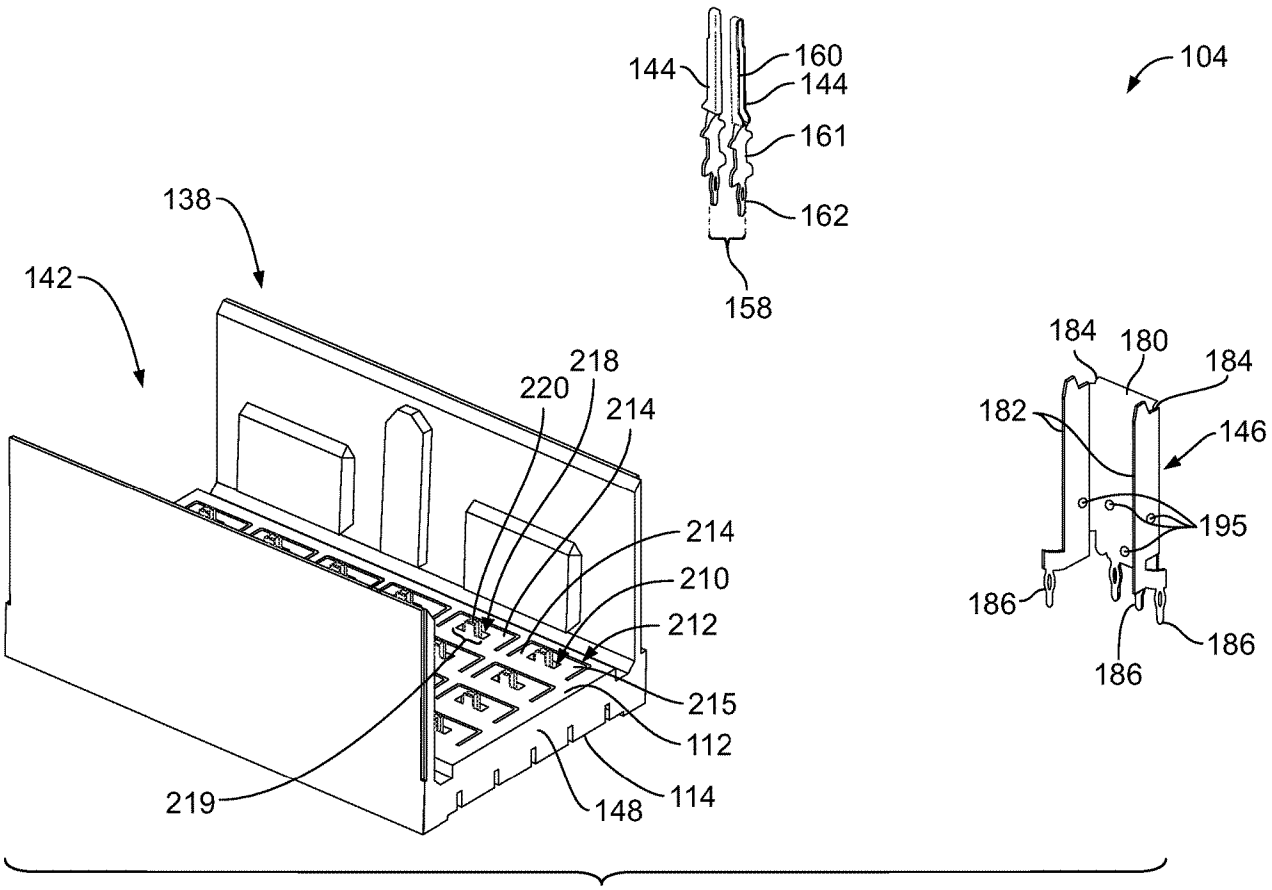
FIG. 3 is an exploded perspective view of the header connector according to an embodiment.

FIG. 3 is an exploded perspective view of the header connector 104 according to an embodiment. The header connector 104 includes the header housing 138, multiple header signal contacts 144, and multiple header ground shields 146. As used herein, the header housing 138, the header signal contacts 144, and the header ground shields 146 may be referred to simply as housing 138, signal contacts 144, and ground shields 146, respectively. Furthermore, the receptacle connector 102 (shown in FIG. 1) may be referred to as a mating connector that mates with the header connector 104. The illustrated pair 158 of signal contacts 144 and the ground shield 146 may be representative of other signal contacts 144 and ground shields 146 of the header connector 104 that are not shown in FIG. 2.

The signal contacts 144 are arranged in contact pairs 158. The signal contacts 144 in each pair 158 may be used to convey high speed differential signals. The signal contacts 144 may extend generally parallel to each other. The signal contacts 144 are composed of one or more conductive metal materials, such as copper, silver, gold, or the like. The signal contacts 144 may be stamped and formed or molded. Each signal contact 144 includes the mating segment 160, a contact tail 162, and an intermediate segment 161 between the mating segment 160 and the tail 162. The mating segment 160 in the illustrated embodiment is a pin or blade, but may have another shape and/or interface in an alternative embodiment, such as a socket. The contact tails 162 of the signal contacts 144 are configured to terminate to the second circuit board 108 (shown in FIG. 1) to electrically connect the signal contacts 144 to the circuit board 108. In the illustrated embodiment, the contact tails 162 are compliant pins, such as eye-of-the-needle pins, that are configured to be through-hole mounted to the circuit board 108, but in other embodiments the contact tails 162 may be solder tails configured to be surface-mounted to the circuit board 108, or the like.

The ground shield 146 in the illustrated embodiment is C-shaped, having a center wall 180 and two side walls 182 that extend from respective edges 184 of the center wall 180. The side walls 182 may extend generally parallel to each other in a common direction from the center wall 180. The center wall 180 and the side walls 182 are generally planar, but the center wall 180 and/or the side walls 182 may be curved in an alternative embodiment. The ground shield 146 may be stamped and formed from a sheet of metal. Although the ground shield 146 has three walls 180, 182 and forms a C-shaped (or U-shaped) cross-section in the illustrated embodiment, the ground shields 146 may have other shapes in alternative embodiments. For example, the ground shield 146 may alternatively have an L-shaped cross-section defined by the center wall 180 and one side wall 182, may have a thin rectangular cross-section defined by the center wall 180 (or one of the side walls 182) only, may have a rectangular or box-shaped cross-section defined by two center walls 180 and two side walls 182, or may include more than four walls.

Like the signal contacts 144, the ground shield 146 includes contact tails 186 for terminating to grounding elements in the second circuit board 108 (FIG. 1), to provide a grounding path between the ground shield 146 and the circuit board 108. The contact tails 186 in the illustrated embodiment are compliant pins configured for through-hole mounting, but the contact tails 186 may be solder tails configured for surface-mounting or another type of mounting interface in an alternative embodiment.

Optionally, the ground shield 146 includes multiple interference protrusions 195 along the center wall 180 and/or the side walls 182. The interference protrusions 195 are designed to increase the friction fit of the ground shield 146 within the base 148 of the housing 138. The interference protrusions 195 may be bumps, bulges, or the like that extend from the plane of the respective walls 180, 182.

The housing 138 is oriented in the illustrated embodiment such that the mating face 112 of the base 148 faces upward. The base 148 defines openings 210 that extend through the base 148 between the mating face 112 and the mounting face 114. The signal contacts 144 are held in the openings 210. For example, the intermediate segments 161 of the signal contacts 144 extend through the openings 210 when the signal contacts 144 are mounted to the base 148. The mating segments 160 protrude upward beyond the mating face 112, and the contact tails 162 protrude downward beyond the mounting face 114. The base 148 also defines ground slots 212 that extend through the base 148 between the mating and mounting faces 112, 114. The ground slots 212 are configured to receive and hold the ground shields 146. The ground slots 212 are C-shaped in the illustrated embodiment to accommodate the shape of the ground shields 146. The openings 210 and the ground slots 212 are arranged in an array of multiple columns and rows along the base 148. The housing 138, or at least the base 148 thereof, is composed of a dielectric material, such as one or more plastics. The base 148 includes divider walls 214 between the openings 210 and the ground slots 212. The divider walls 214 separate the openings 210 from the ground slots 212, and therefore define at least portions of the openings 210 and the ground slots 212. The divider walls 214 are integral to the base 148 and have top surfaces 215 that define portions of the mating face 112 of the base 148. Some of the divider walls 214 are disposed between adjacent ground slots 212. For example, the divider walls 214 between the ground slots 212 and the openings 210 define inner edges of the ground slots 212, and the divider walls 214 between adjacent ground slots 212 define outer edges of the ground slots 212.

During assembly, the ground shields 146 are loaded into corresponding ground slots 212 and the signal contacts 144 are loaded into the openings 210. The interference protrusions 195 on the ground shield 146 may engage the surfaces of the divider walls 214 surrounding the ground slot 212 to increase the frictional fit of the ground shield 146 in the ground slot 212. The divider walls 214 electrically insulate the signal contacts 144 from other signal contacts 144 and from the ground shields 146.

In the illustrated embodiment, the openings 210 in the base 148 are signal apertures 218 that are sized and shaped to each receive and hold a single signal contact 144 therein. Thus, the signal apertures 218 are arranged in pairs 219 along the base 148 to accommodate each of the signal contacts 144 in a corresponding contact pair 158. The signal apertures 218 optionally may include crush ribs (not shown) therein to increase the frictional fit of the signal contacts 144 within the signal apertures 218. In an alternative embodiment, the openings 210 may be large enough to accommodate both signal contacts 144 of a contact pair 158, as described with reference to FIG. 12 herein.

In an embodiment, the header connector 104 includes impedance control (IC) members 221 on the base 148. The IC members 221, illustrated, for example in FIG. 4, extend beyond the mating face 112 of the base 148 into the cavity 142 of the housing 138. Each of the IC members 221 is associated with the signal apertures 218 of a pair 219, such that the IC member 221 at least partially surrounds the signal apertures 218. For example, each of the IC members 221 may be located between and/or adjacent to the signal apertures 218 in the associated pair 219. In the illustrated embodiment, the IC members 221 are inter-contact protrusions 220 that are located between the signal apertures 218, but do not fully surround the signal apertures 218. For example, the inter-contact protrusions 220 are not disposed adjacent to the signal apertures 218 between the signal apertures 218 and the ground slots 212. In other embodiments, the IC members 221 may have inter-shield protrusions 223 (shown in FIG. 13) and/or contact-shield protrusions 225 (shown in FIG. 13) in addition to, or instead of, the inter-contact protrusions 220. The inter-shield protrusions 223 and the contact-shield protrusions 225 are disposed adjacent to the signal apertures 218 and at least partially border each pair 219. The IC members 221 are formed of a dielectric material, and are configured to provide impedance control across a mating interface between the receptacle and header connectors 102, 104 (shown in FIG. 1). The IC members 221 are configured to provide impedance control when the connectors 102, 104 are fully mated to one another and when the connectors 102, 104 are only partially mated.

Figure 4:
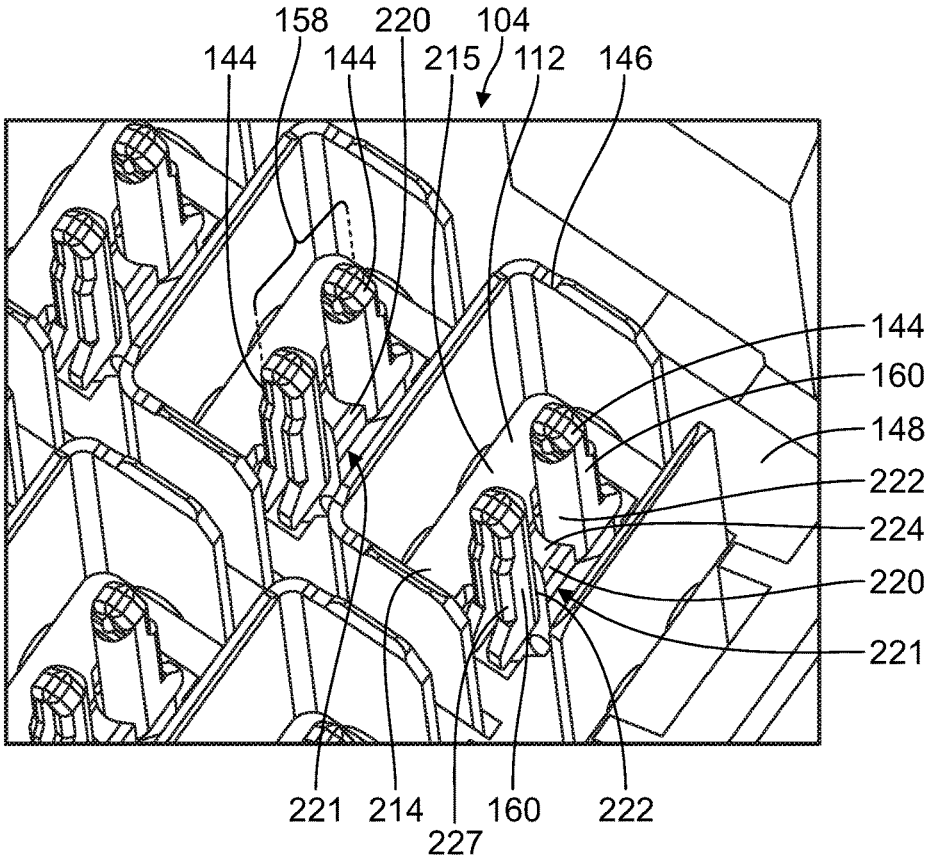
FIG. 4 is an assembled perspective view of a portion of the header connector shown in FIG. 3.

FIG. 4 is an assembled perspective view of a portion of the header connector 104 shown in FIG. 3. The signal contacts 144 and the ground shields 146 are held in the base 148 and fixed in place. For example, the signal contacts 144 are each held in different signal apertures 218. The mating segments 160 of the signal contacts 144 and the ground shields 146 protrude beyond the mating face 112 of the base 148. The inter-contact protrusions 220 (which represent the IC members 221 of the electrical connector 104) extend a height beyond the mating face 112 of the base 148 (e.g., beyond the top surfaces 215 of the divider walls 214). In the illustrated embodiment, the inter-contact protrusions 220 are integral to the base 148. For example, the inter-contact protrusions 220 are permanently fixed to the base 148. The inter-contact protrusions 220 may be formed during a common forming process with the base 148, such as within a common mold, or the inter-contact protrusions 220 may be fixed to the base 148 during a secondary processing step, such as via welding. Since the inter-contact protrusions 220 are integral to the base 148, there are no seams between the protrusions 220 and the base 148, and no fasteners are used to connect the protrusions 220 to the base 148.

The inter-contact protrusions 220 are composed of a dielectric material, such as one or more plastics or other polymers. Since the inter-contact protrusions 220 protrude beyond the mating face 112, the base 148 has a staggered height. For example, the base 148 is taller along portions that include the inter-contact protrusions 220 than portions between the inter-contact protrusions 220.

The inter-contact protrusions 220 are each disposed between the mating segments 160 of the two signal contacts 144 of a different contact pair 158. The inter-contact protrusions 220 partially surround the mating segments 160 of the corresponding two signal contacts 144 along inner portions 222 of the signal contacts 144. The inner portions 222 of the signal contacts 144 in each pair 158 face generally towards each other. The inter-contact protrusions 220 in the illustrated embodiment do not surround the signal contacts 144 along an entire perimeter of the signal contacts 144. Therefore, the mating segments 160 are open (e.g., not surrounded by the inter-contact protrusions 220) along outer portions 227 of the signal contacts 144 that generally face away from the other signal contact 144 in the contact pair 158. The inter-contact protrusions 220 extend a height from the mating face 112 of the base 148 to respective top surfaces 224 of the inter-contact protrusions 220. In one or more embodiments, the heights of the inter-contact protrusions 220 may be between about 0.2 mm and about 1.2 mm. In some embodiments, the heights of the inter-contact protrusions 220 may be between about 0.4 mm and about 1.0 mm. The heights of the inter-contact protrusions 220 above the mating face 112 are less than the heights that the mating segments 160 of the signal contacts 144 extend beyond the mating face 112. Therefore, the inter-contact protrusions 220 only extend between the mating segments 160 for a portion of the heights of the mating segments 160.

Figure 5:
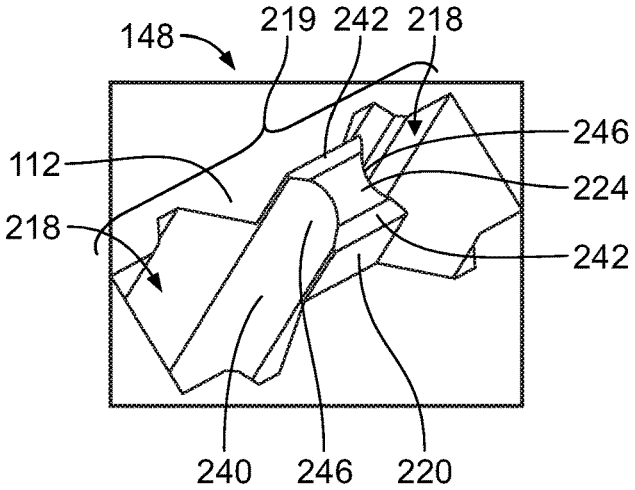
FIG. 5 is a close-up perspective view of a portion of a base of the header connector showing a pair of signal apertures and an inter-contact protrusion.

FIG. 5 is a close-up perspective view of a portion of the base 148 of the header connector 104 (shown in FIG. 1) showing a pair 219 of signal apertures 218 and an inter-contact protrusion 220. In an embodiment, the signal apertures 218 in the pair 219 are separated from each other by a septum or partition 240. The septum 240 is an integral component of the base 148. Although not shown in FIG. 5, the septum 240 may extend the height of the base 148 between the mating face 112 and the mounting face 114 (shown in FIG. 3). In the illustrated embodiment, the inter-contact protrusion 220 is integral to the septum 240, such that the inter-contact protrusion 220 is an extension of the septum 240 above the mating face 112.

The top surface 224 of the inter-contact protrusion 220 in the illustrated embodiment is generally planar and includes chamfered edges 242. The chamfered edges 242 provide a lead-in that prohibits stubbing with the walls 208 (shown in FIG. 2) of the receptacle housing 120 (FIG. 2) during mating. For example, the chamfered edges 242 may engage the ramped inner surfaces 209 (FIG. 2) of the walls 208 during mating, and the complementary slopes prevent stubbing. In the illustrated embodiment, the inter-contact protrusion 220 has concave sides 246 that face the signal contacts 144 (shown in FIG. 4) in the signal apertures 218 on either side of the inter-contact protrusion 220. The concave sides 246 may extend continuously from the inter-contact protrusion 220 along the septum 240. The concave sides 246 are configured to curve partially around the signal contacts 144. The planar top surface 224, the chamfered edges 242, and the concave sides 246 are optional, and the inter-contact protrusion 220 may have other shapes in other embodiments.

FIG. 6 is a cross-sectional view of portions of the header connector 104 and the receptacle connector 102 of the connector system 100 in a partially mated position. During mating, the mating segments 160 of the header signal contacts 144 are received in the signal openings 132 of the receptacle housing 120. The mating segments 160 engage and electrically connect to corresponding receptacle signal contacts 280 within the signal openings 132 to establish the conductive signal transmission path across the connectors 102, 104. The receptacle signal contacts 280 in the illustrated embodiment are paddles, but may have other shapes and/or interfaces in other embodiments. The header ground shields 146 extend into the ground slots 134 of the receptacle housing 120. Within the ground slot 134, each ground shield 146 engages and electrically connects to corresponding receptacle ground contacts 282 of the receptacle connector 102 to establish a grounding path and/or signal return path across the connectors 102, 104.

When the connectors 102, 104 are partially mated, as shown in FIG. 6, the header signal contacts 144 are electrically connected to the receptacle signal contacts 280 (and the header ground shields 146 are electrically connected to the receptacle ground contacts 282). However, the header housing 138 is not fully mated with the receptacle housing 120. For example, the header housing 138 has not reached a hard stop position that prevents further movement of the header connector 104 in a mating direction towards the receptacle connector 102 (or vice-versa). As shown in FIG. 6, the mating face 112 of the base 148 is spaced apart from the mating face 129 of the receptacle housing 120 by an air gap 284. The header signal contacts 144 and the ground shield 146 extend across the gap 284 into the corresponding signal openings 132 and ground slot 134.

The connectors 102, 104 may be partially mated due to the system or chassis on which the connectors 102, 104 are mounted. For example, due to aggregated tolerances in the system, the distance between the two circuit boards 106, 108 (shown in FIG. 1) may be farther apart than the combined length of the connectors 102, 104 when fully mated. The difference between the distance across the circuit boards 106, 108 and the length of the fully-mated connectors 102, 104 is represented by the length of the air gap 284 between the mating faces 112, 129.

The air gap 284 may cause an impedance discontinuity along the signal transmission path because the electrical signals are surrounded by solid dielectric material along lengths through the receptacle housing 120 and the header housing 138, but the electrical signals are only surrounded by air within the gap 284. The impedance discontinuity may negatively affect the signal performance, especially at higher signal speeds of at least 10 Gbps or at least 20 Gbps.

The IC members 221 of the header connector 104 extend beyond the mating face 112 into the air gap 284. The IC members 221 are configured to at least partially stabilize the impedance of the connector system 100 when the receptacle and header connectors 102, 104 are partially mated. For example, the IC members 221 stagger the length of the air gap 284 between the receptacle housing 120 and the header housing 138. Thus, the portions of the air gap 284 along the IC members 221 do not extend all the way to the mating face 112, but the portions of the air gap 284 outside of the IC members 221 do extend to the mating face 112. The air gap 284 is therefore staggered or shifted, and does not have a uniform size, across the connectors 102, 104. The staggered air gap 284 may reduce the impedance discontinuity, or at least the detrimental effect of the discontinuity on the electrical signal performance.

In the illustrated embodiment shown in FIG. 6, the IC member 221 is defined by the inter-contact protrusion 220 disposed between two header signal contacts 144. The inter-contact protrusion 220 aligns with the rib 204 of the receptacle housing 120. Since the rib 204 is recessed relative to the mating face 129 of the receptacle housing 120, the receptacle housing 120 can accommodate the inter-contact protrusion 220 in the space between the mating end 206 of the rib 204 and the mating face 129.

Figure 7:
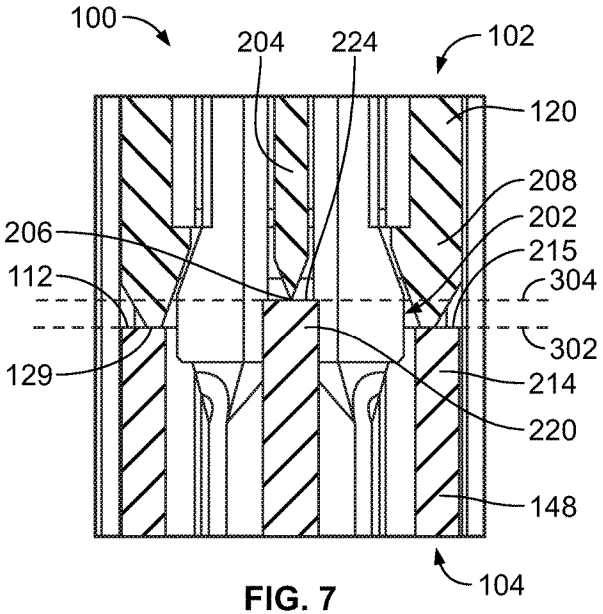
FIG. 7 is a cross-sectional view of portions of the header connector and the receptacle connector of the connector system in a fully mated position.

FIG. 7 is a cross-sectional view of portions of the header connector 104 and the receptacle connector 102 of the connector system 100 in a fully mated position. When the connectors 102, 104 are allowed to fully mate, the mating face 129 of the receptacle housing 120 abuts the mating face 112 of the base 148 at a mating interface 302. There is no air gap between the mating face 129 of the receptacle housing 120 and the mating face 112 of the base 148, so there is little, if any, impedance discontinuity between the connectors 102, 104. The engagement between the mating faces 129, 112 provides a hard stop that blocks additional movement of the connectors 102, 104 towards each other. More specifically, at the mating interface 302, the top surfaces 215 of the divider walls 214 of the base 148 abut against the walls 208 of the receptacle housing 120 that define the guide tunnel 202.

The inter-contact protrusion 220 extends across the mating interface 302 and is received into the guide tunnel 202. As shown in FIG. 7, the top surface 224 of the inter-contact protrusion 220 may abut the mating end 206 of the rib 204 when the connectors 102, 104 are fully mated. The inter-contact protrusion 220 engages the rib 204 along an engagement plane 304 that is spaced apart from (e.g., stepped above) the mating interface 302. In an alternative embodiment, the inter-contact protrusion 220 extends into the guide tunnel 202 but does not engage the mating end 206 of the rib 204 when the connectors 102, 104 are fully mated.

Figure 9:
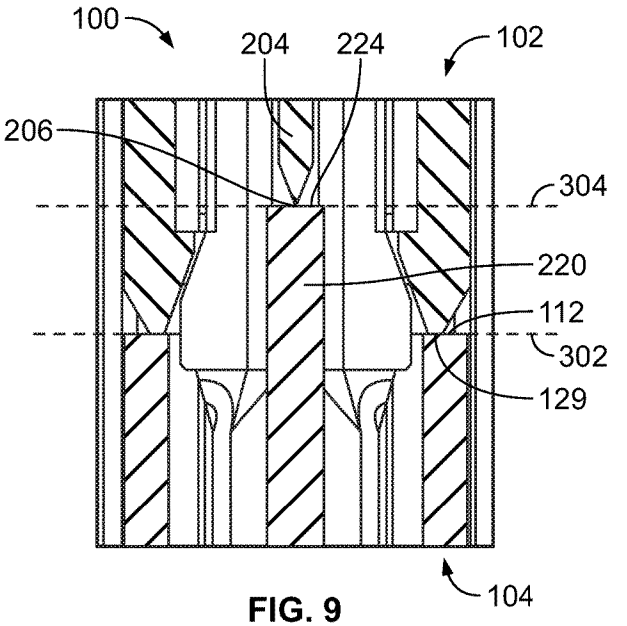
FIG. 9 is a cross-sectional view of the header connector and the receptacle connector of FIG. 8 in a fully mated position.
Figure 8:
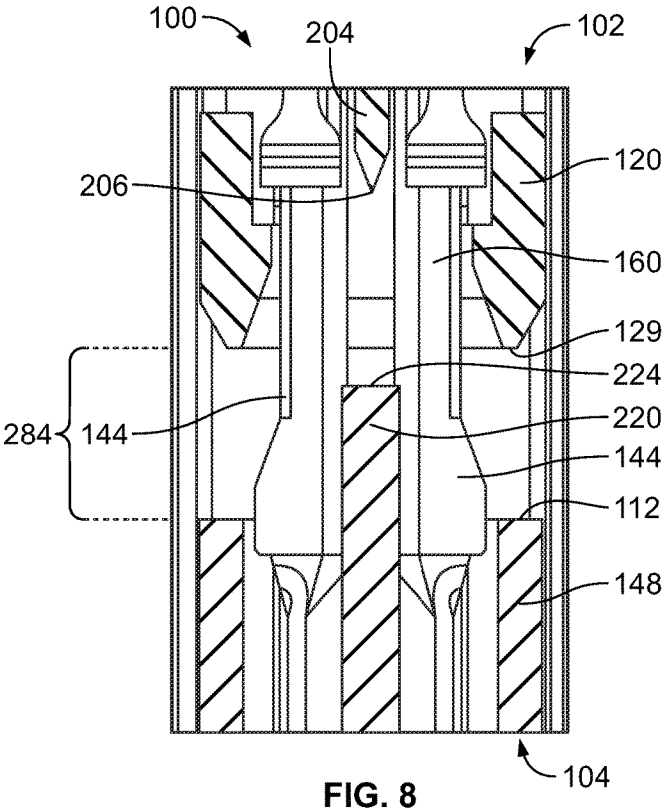
FIG. 8 is a cross-sectional view of the header connector and the receptacle connector of the connector system according to an alternative embodiment, shown in a partially mated position.

FIG. 8 is a cross-sectional view of the header connector 104 and the receptacle connector 102 of the connector system 100 according to an alternative embodiment, shown in a partially mated position. FIG. 9 is a cross-sectional view of the header connector 104 and the receptacle connector 102 of FIG. 8 in a fully mated position.

The header connector 104 in FIG. 8 differs from the header connector 104 shown in FIG. 6 because the inter-contact protrusion 220 in FIG. 8 is taller than the inter-contact protrusion 220 in FIG. 6. Thus, the inter-contact protrusion 220 in FIG. 8 extends a greater height from the mating face 112 of the base 148 than the inter-contact protrusion 220 in FIG. 6. For example, the inter-contact protrusion 220 in FIG. 8 may have a height of about 0.8 mm, while the inter-contact protrusion 220 in FIG. 6 has a height of about 0.3 mm. As shown in FIG. 8, the inter-contact protrusion 220 almost extends across the entire length of the air gap 284 between the mating faces 112, 129. The taller height of the inter-contact protrusion 220 may reduce the impedance discontinuity along the gap 284 because the inter-contact protrusion 220 partially surrounds the mating segments 160 of the header signal contacts 144 along a greater amount of the air gap 284 than the embodiment shown in FIG. 6. In addition, since the inter-contact protrusion 220 is taller, the air gap 284 staggered or shifted a greater extent due to the greater step distances between the mating face 112 and the top surfaces 224 of the taller inter-contact protrusions 220.

The receptacle connector 102 in FIG. 8 differs from the receptacle connector 102 shown in FIG. 6 because the rib 204 is recessed a greater distance from the mating face 129 of the receptacle housing 120 in FIG. 8 than in the embodiment shown in FIG. 6. The rib 204 is recessed to be able to accommodate the taller inter-contact protrusion 220 of the header connector 104 when the connectors 102, 104 are fully mated, as shown in FIG. 9. For example, the mating end 206 of the rib 204 may be recessed a distance of about 0.8 mm from the mating face 129 of the receptacle housing 120 in FIG. 8, while the mating end 206 of the rib 204 in FIG. 6 may be recessed a distance of about 0.3 mm from the mating face 129.

Referring to FIG. 9, when the connectors 102, 104 are fully mated, the mating interface 302 between the mating faces 112, 129 is the same (e.g., same location and defined between the same components) as the embodiment shown in FIG. 7. But, the engagement plane 304 between the top surface 224 of the inter-contact protrusion 220 and the mating end 206 of the rib 204 is spaced apart from the mating interface 302 by a greater distance in FIG. 9 than in the embodiment shown in FIG. 7.

Figure 10:
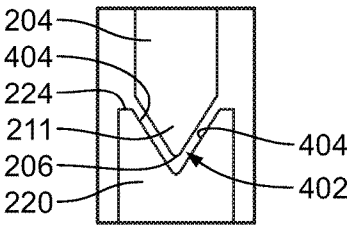
FIG. 10 is a close-up view of one of the inter-contact protrusions of the header connector and one rib of the receptacle connector according to a first alternative embodiment.

FIG. 10 is a close-up view of one of the inter-contact protrusions 220 of the header connector 104 (shown in FIG. 1) and one of the ribs 204 of the receptacle connector 102 (FIG. 1) according to a first alternative embodiment. The rib 204 includes a tapered tip 211 at the mating end 206. The top surface 224 of the inter-contact protrusion 220 includes an indentation 402. The indentation 402 is a V-shaped notch or valley, and is sized and shaped to accommodate the tapered tip 211 of the rib 204. For example, as the receptacle and header connectors 102, 104 are fully mated, the tapered tip 211 is received at least partially into the indentation 402 of the inter-contact protrusion 220. Thus, the rib 204 nests with the inter-contact protrusion 220. This nesting may reduce the size and/or amount of air gaps at the engagement plane 304 (shown in FIG. 9), which may reduce an impedance discontinuity along the engagement plane 304. The tapered tip 211 may mechanically engage one or both sloped surfaces 404 that define the indentation 402 when fully mated. Alternatively, the tapered tip 211 may enter the indentation 402 without engaging either of the sloped surfaces 404 (as shown in FIG. 10).

Figure 11:
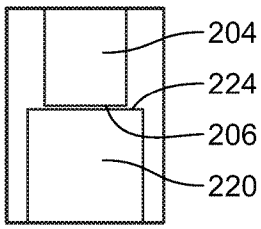
FIG. 11 is a close-up view of one of the inter-contact protrusions of the header connector and one of the ribs of the receptacle connector according to a second alternative embodiment.

FIG. 11 is a close-up view of one of the inter-contact protrusions 220 of the header connector 104 (shown in FIG. 1) and one of the ribs 204 of the receptacle connector 102 (FIG. 1) according to a second alternative embodiment. The top surface 224 of the inter-contact protrusion 220 in FIG. 11 is generally planar. The mating end 206 of the rib 204 is also generally planar, and does not define a tapered tip. Thus, when the connectors 102, 104 are fully mated, the planar top surface 224 of the inter-contact protrusion 220 may abut the planar mating end 206 of the rib 204. For example, the embodiment in FIG. 11 may be similar to the embodiment shown in FIG. 9 except that the rib 204 has a flat mating end 206 instead of the tapered tip 211. It may be easier and/or cheaper to produce the generally flat or planar end 206 of the rib 204 than the tapered tip 211.

Figure 12:
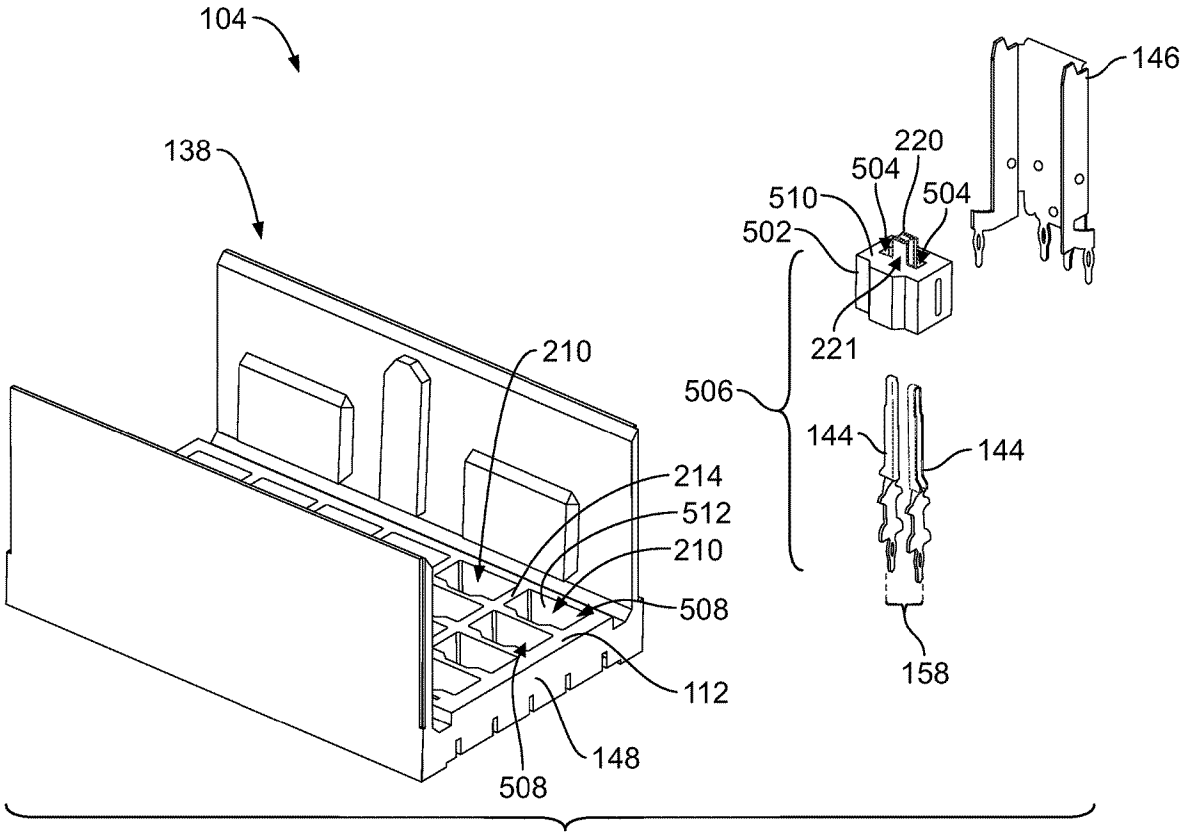
FIG. 12 is an exploded perspective view of the header connector according to an alternative embodiment.

FIG. 12 is an exploded perspective view of the header connector 104 according to an alternative embodiment. In FIG. 12, the header signal contacts 144 embedded within dielectric inserts 502. For example, each contact pair 158 is embedded within a corresponding dielectric insert 502, such that the contacts 144 are held in parallel and spaced apart from each other by material of the dielectric insert 502. Although the dielectric insert 502 is formed and shown separated from the contact pair 158 in the illustrated embodiment, the dielectric insert 502 optionally may be formed by overmolding the contacts 144 with a dielectric material. The contacts 144 are held in apertures 504 of the dielectric insert 502. The dielectric inserts 502 are formed to include the IC members 221. The IC members 221 extend beyond a top surface 510 of the dielectric insert 502. In the illustrated embodiment, the IC members 221 are represented by inter-contact protrusions 220 located between the two apertures 504. The combination of the dielectric insert 502 and the contact pair 158 defines a signal pod 506.

In the illustrated embodiment, the openings 210 in the base 148 of the header housing 138 that hold the header signal contacts 144 are chambers 508 that are configured to receive the signal pods 506 therein. The chambers 508 are defined by the divider walls 214. Optionally, the chambers 508 may be large enough to accommodate the ground shield 146 in addition to the signal pod 506, and the dielectric insert 502 electrically insulates the signal contacts 144 from the ground shield 146. Alternatively, the chambers 508 only accommodate the signal pods 506, and the base 148 may define separate ground slots for accommodating the ground shields 146. The sides of the dielectric insert 502 may engage edges 512 of the chambers 508 via an interference fit to secure the signal pod 506 within the chamber 508.

When the signal pod 506 is loaded in the chamber 508, the top surface 510 of the dielectric insert 502 may align generally flush with the mating face 112 of the base 148, and the IC member 221 of the dielectric insert 502 protrudes beyond the mating face 112 of the base 148. Thus, the embodiment shown in FIG. 12 differs from the embodiment shown in FIG. 3 because the IC members 221 are not integral to the base 148 in FIG. 12, but rather are integral components of the dielectric inserts 502 that are loaded into the base 148 during assembly of the header connector 104.

Figure 13:
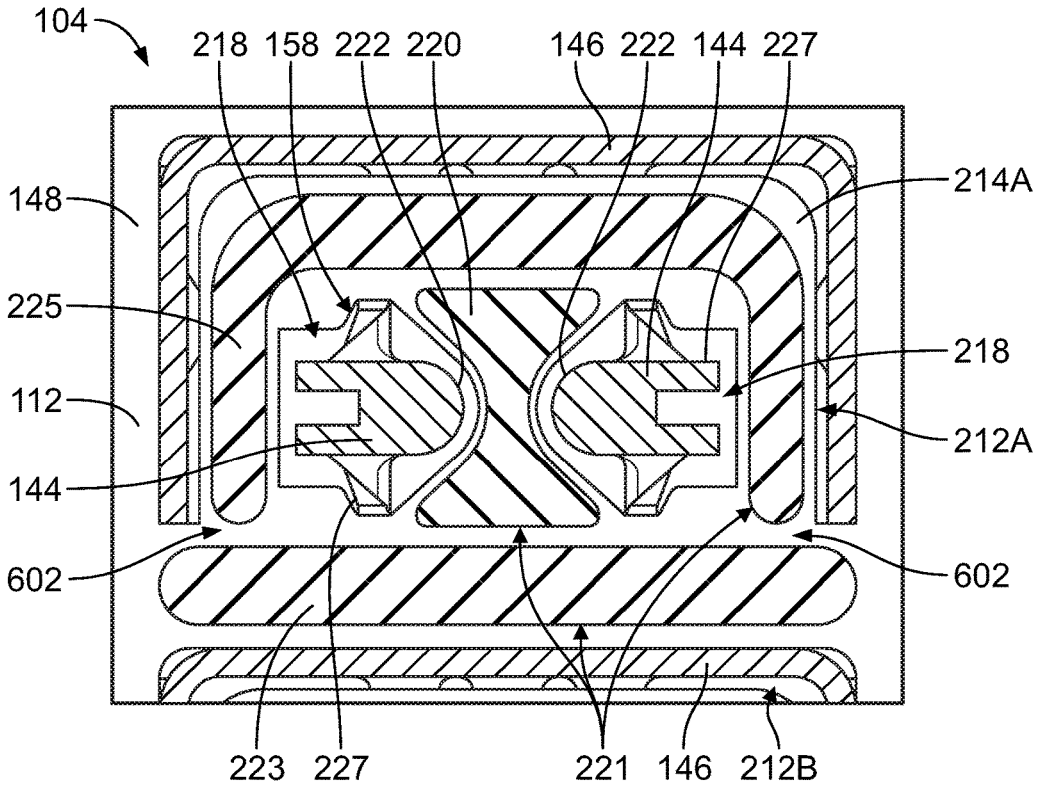
FIG. 13 is a top-down cross-sectional view of a portion of the header connector according to an alternative embodiment.

FIG. 13 is a top-down cross-sectional view of a portion of the header connector 104 according to an alternative embodiment. The cross-section in the illustrated embodiment is taken along a plane that is suspended above the mating face 112 of the base 148. The cross-sectional plane extends through the signal contacts 144 of a contact pair 158, ground shields 146, and an IC member 221. The IC member 221 in the illustrated embodiment includes an inter-contact protrusion 220, an inter-shield protrusion 223, and a contact-shield protrusion 225. The inter-contact protrusion 220 is disposed between the inner portions 222 of the signal contacts 144 in the contact pair 158. The inter-shield protrusion 223 and the contact-shield protrusion 225 are disposed adjacent to the signal contacts 144 and at least partially border the signal contacts 144, but are not located directly between the two contacts 144. For example, the inter-shield protrusion 223 and the contact-shield protrusion 225 extend along the outer portions 227 of the signal contacts 144 in the contact pair 158.

The contact-shield protrusion 225 is disposed between the contact pair 158 and the associated ground shield 146 that surrounds the contact pair 158 on multiple sides. In the illustrated embodiment, the ground shield 146 is U-shaped and surrounds the contact pair 158 on three sides. The contact-shield protrusion 225 is also U-shaped and projects from a divider wall 214A disposed between the signal apertures 218 and the associated ground slot 212A.

The inter-shield protrusion 223 is located between the ground shield 146 that is associated with the contact pair 158 and an adjacent ground shield 146 in the array of ground shields 146 on the connector 104. In the illustrated embodiment, the inter-shield protrusion 223 surrounds the contact pair 158 along an open, fourth side of the contact pair 158 that is not surrounded by the ground shield 146 associated with the contact pair 158. The inter-shield protrusion 223 may be linear, and projects from a divider wall 214B disposed between the signal apertures 218 and the adjacent ground slot 212*b*.

The combination of the contact-shield protrusion 225 and the inter-shield protrusion 223 borders almost an entire perimeter of the contact pair 158 along the height of the protrusions 223, 225, with the only non-bordered areas being located at spaces 602 between the inter-shield protrusion 223 and the contact-shield protrusion 225.

In the illustrated embodiment, when the header connector 104 is mated to the receptacle connector 102 (shown in FIG. 1), all three of the protrusions 220, 223, and 225 of the IC member 221 extend across the mating interface and are configured to be received into a receiving space of the receptacle connector 102. All of the protrusions 220, 223, and 225 are composed of a dielectric (e.g., electrically-insulative) material. The three protrusions 220, 223, and 225 are formed integral to the base 148 in the illustrated embodiment, but may be formed integral to a discrete dielectric insert according to an alternative embodiment, such as the dielectric insert 502 in FIG. 12. The three protrusions 220, 223, and 225 may have the same or varying heights from the mating face 112, although all of the protrusions 220, 223, and 225 are shorter than the heights of the mating segments 160 (shown in FIG. 4) of the signal contacts 144. In the illustrated embodiment, the three protrusions 220, 223, and 225 are discrete from each other, such that the IC member 221 represented by the protrusions 220, 223, and 225 is segmented. But, alternatively, the protrusions 220, 223, and 225 may be connected to define a unitary IC member 221, as shown in FIG. 14.

Figure 14:
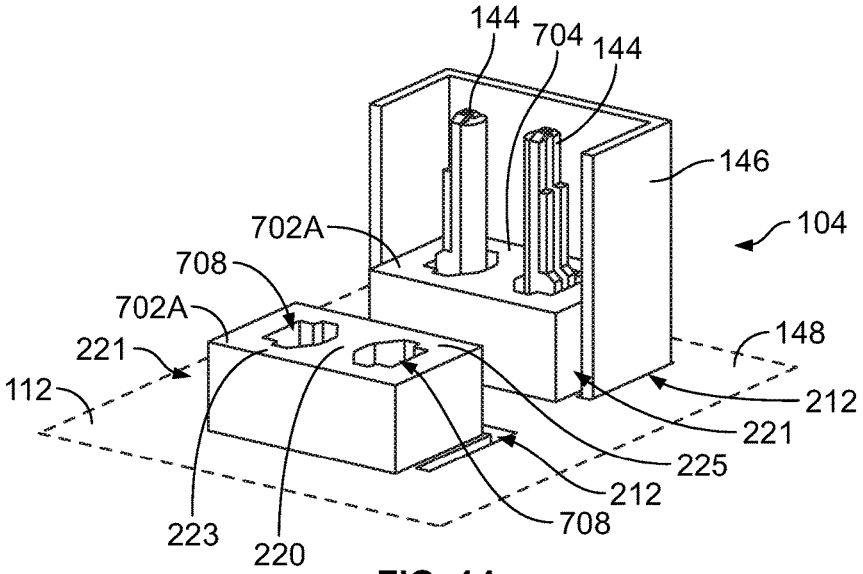
FIG. 14 illustrates an impedance control (IC) member of the header connector according to a first alternative embodiment.

FIGS. 14-17 illustrate IC members 221 of the header connector 104 according to different embodiments. In each of the illustrated embodiments, the IC member 221 is defined by at least two of the inter-contact protrusion 220, the contact-shield protrusion 225, and the inter-shield protrusion 223 that are connected to define a unitary body. In FIG. 14, the unitary body 702*a* of the IC member 221 includes all three protrusions 220, 223, 225. FIG. 14 shows two adjacent IC members 221 that project above the mating face 112 of the base 148. One of the bodies 702*a* is shown with associated signal contacts 144 and a ground shield 146. The ground slots 212, and the U-shaped ground shields 146 received in the ground slots 212, surround the bodies 702A on three sides. The bodies 702A define two discrete signal openings 708 that align with the signal apertures 218 (shown in FIG. 3) and receive the signal contacts 144 therethrough. Both the ground shield 146 and the signal contacts 144 project beyond a top surface 704 of the body 702A, which itself is stepped above the mating face 112. It is recognized that the unitary IC members 221 shown in FIG. 14 are similar to the segmented IC member 221 shown in FIG. 13, except that the three protrusions 220, 223, and 225 are connected to each other in FIG. 14 instead of spaced apart and discrete from each other.

Figure 15:
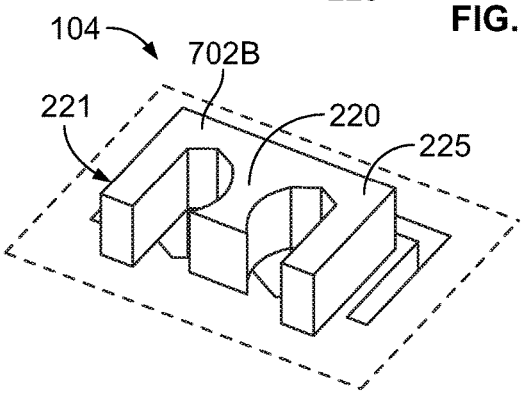
FIG. 15 illustrates the IC member of the header connector according to a second alternative embodiment.
Figure 16:
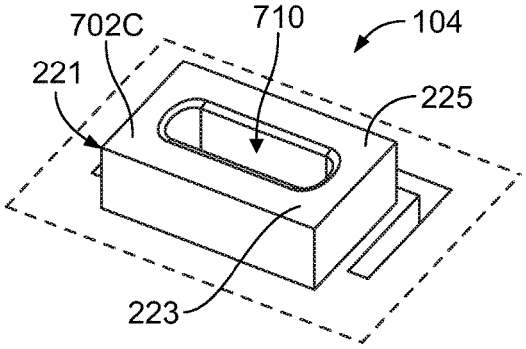
FIG. 16 illustrates the IC member of the header connector according to a third alternative embodiment.
Figure 17:
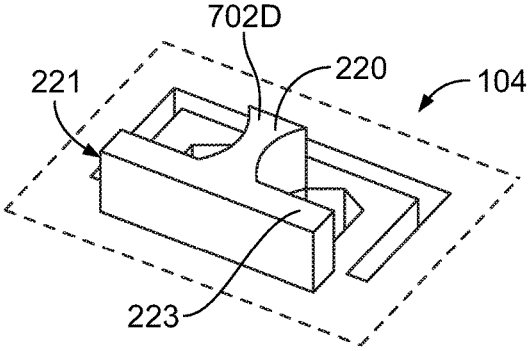
FIG. 17 illustrates the IC member of the header connector according to a fourth alternative embodiment.

The IC member 221 in FIG. 15 has a unitary body 702B defined by the inter-contact protrusion 220 and the contact-shield protrusion 225. The IC member 221 in the illustrated embodiment lacks the inter-shield protrusion 223. In FIG. 16, the IC member 221 has a unitary body 702C defined by the contact-shield protrusion 225 and the inter-shield protrusion 223, and lacking the inter-contact protrusion 220. The unitary body 702C defines a single opening 710 that receives both signal contacts 144 (shown in FIG. 14) therein, and does not include any portion that extends between the two signal contacts 144. In FIG. 17, the IC member 221 has a unitary body 702D that is defined by the inter-contact protrusion 220 and the contact-shield protrusion 225. Although not shown, the bodies 702A-D of the IC members 221 in FIGS. 14-17 may have chamfered edges to reduce the risk of stubbing during mating, similar to the chamfered edges 242 of the inter-contact protrusion 220 shown in FIG. 5.

Although not shown, in other embodiments the IC members 221 of the header connector 104 may be similar to any of the unitary bodies 702B, 702C, 702D shown in FIGS. 15-17, except that the protrusions 220, 223, 225 in the respective bodies 702B, 702C, 702D are segmented instead of unitary and one-piece. In other non-illustrated embodiments, the IC member 221 may be defined by the inter-shield protrusion 223 alone or the contact-shield protrusion 225 alone.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector comprising:

a housing including a base having a mating face, the base including an array of openings along the mating face;

plural signal contacts arranged in contact pairs and held in the openings of the base, the signal contacts including mating segments that extend a height beyond the mating face of the base for electrically connecting to corresponding mating signal contacts of a mating connector; and plural impedance control (IC) members on the base, the IC members extending a height beyond the mating face of the base that is less than the height of the mating segments of the signal contacts, each of the IC members disposed adjacent to or between the signal contacts of a corresponding contact pair, wherein top surfaces of the IC members engaging the mating housing along an engagement plane that is spaced apart from the mating face of the base.

2. The electrical connector of claim 1, wherein the IC members extend beyond the mating face to the top surfaces of the IC members, the top surfaces of the IC members configured to abut the mating housing of the mating connector when the housing is fully mated to the mating housing.

3. The electrical connector of claim 1, wherein the openings of the base are signal apertures that are arranged in pairs, the base including septums that are integral to the base, each septum extending between and separating the signal apertures of a corresponding pair along a height of the base between the mating face and a mounting face that is opposite the mating face, wherein the IC members include inter-contact protrusions that are integral portions of the septums of the base, each inter-contact protrusion disposed between the signal contacts in a corresponding contact pair.

4. The electrical connector of claim 1, wherein the base defines ground slots through the base that are configured to hold ground shields therein, the base including divider walls located between adjacent ground slots, the divider walls having top surfaces that define the mating face of the base, the IC members projecting beyond the top surfaces of the divider walls.

5. The electrical connector of claim 1, wherein the IC members include inter-contact protrusions that are each disposed between the signal contacts in a corresponding contact pair, each of the inter-contact protrusions is configured to extend into a corresponding guide tunnel of a mating housing of the mating connector when the housing is fully mated to the mating housing.

6. The electrical connector of claim 1, wherein the IC members extend beyond the mating face to top surfaces of the IC members, the top surfaces of the IC members having chamfered edges.

7. The electrical connector of claim 1, wherein the IC members extend beyond the mating face to top surfaces of the IC members, the top surfaces of the IC members being generally planar.

8. The electrical connector of claim 1, wherein each of the IC members represents either: (i) an inter-contact protrusion disposed between the signal contacts in a corresponding contact pair, iii) a contact-shield protrusion disposed adjacent to the signal contacts in the corresponding contact pair between the signal contacts and a ground shield of the electrical connector that surrounds the contact pair along at least two sides, or (iii) an inter-shield protrusion disposed adjacent to the signal contacts in the corresponding contact pair between the ground shield that surrounds the contact pair on at least two sides and an adjacent ground shield of the electrical connector.

9. A connector system comprising:

a header connector including a header housing having a mating face, the header housing holding plural header signal contacts, the header signal contacts having mating segments that extend beyond the mating face, the header signal contacts arranged in contact pairs within the header housing, the header housing including impedance control (IC) members that project beyond the mating face, the IC members including inter-contact protrusions that are located between the mating segments of the header signal contacts in each contact pair; and a receptacle connector including a receptacle housing having a mating face, the mating face of the receptacle housing configured to abut the mating face of the header housing at a mating interface when the receptacle connector is fully mated to the header connector, the receptacle housing defining guide tunnels along the mating face, each guide tunnel fluidly connected to a corresponding pair of signal openings that extend through the receptacle housing such that the guide tunnel provides a lead-in space to the pair of signal openings, the signal openings configured to receive the mating segments of the header signal contacts therein through the guide tunnels to electrically connect to receptacle signal contacts held in the signal openings, wherein the IC members of the header housing are configured to extend across the mating interface when the header connector is fully mated to the receptacle connector such that the inter-contact protrusions are received into the guide tunnels of the receptacle housing.

10. The connector system of claim 9, wherein the signal openings in each pair of signal openings in the receptacle housing are separated from each other by a rib, the ribs each having a mating end that is recessed relative to the mating face of the receptacle housing such that the mating end of the rib is separated from the mating face by the corresponding guide tunnel, the ribs aligning with the inter-contact protrusions of the header housing.

11. The connector system of claim 10, wherein the mating ends of the ribs are configured to abut top surfaces of the inter-contact protrusions when the header connector is fully mated to the receptacle connector.

12. The connector system of claim 10, wherein the mating ends of the ribs are recessed from the mating face of the receptacle housing by a distance between about 0.5 mm and about 1.5 mm.

* * * * *